US010006186B2

(12) United States Patent
Han

(10) Patent No.: US 10,006,186 B2
(45) Date of Patent: Jun. 26, 2018

(54) EARTH ANCHOR AND CONSTRUCTION METHOD THEREFOR

(71) Applicants: INCT CO., LTD., Seoul (KR); Man-Yop Han, Seoul (KR)

(72) Inventor: Man-Yop Han, Seoul (KR)

(73) Assignees: INCT CO., LTD., Seoul (KR); Man-Yop Han, Seoul (KR)

( * ) Notice: Subject to any disclaimer, the term of this patent is extended or adjusted under 35 U.S.C. 154(b) by 0 days. days.

(21) Appl. No.: 15/121,352

(22) PCT Filed: Feb. 23, 2015

(86) PCT No.: PCT/KR2015/001688

§ 371 (c)(1),
(2) Date: Aug. 24, 2016

(87) PCT Pub. No.: WO2015/126188

PCT Pub. Date: Aug. 27, 2015

(65) Prior Publication Data

US 2016/0362866 A1 Dec. 15, 2016

(30) Foreign Application Priority Data

Feb. 24, 2014 (KR) ..... 10-2014-0021502
Feb. 24, 2014 (KR) ..... 10-2014-0021503
Feb. 24, 2014 (KR) ..... 10-2014-0021504

(51) Int. Cl.

| | |
|---|---|
| ***E02D 29/02*** | (2006.01) |
| ***E02D 17/04*** | (2006.01) |
| ***E02D 5/76*** | (2006.01) |
| ***E02D 5/80*** | (2006.01) |

(52) U.S. Cl.
CPC ..... *E02D 29/0233* (2013.01); *E02D 5/76* (2013.01); *E02D 5/80* (2013.01); *E02D 17/04* (2013.01); *E02D 5/808* (2013.01)

(58) Field of Classification Search
USPC ..... 405/262, 284, 285
See application file for complete search history.

(56) References Cited

U.S. PATENT DOCUMENTS 3,999,391 A * 12/1976 Meredith ..... E02D 5/76 405/259.5
4,725,168 A * 2/1988 Fagundes ..... E02D 5/74 248/289.11

FOREIGN PATENT DOCUMENTS

| | | | |
|---|---|---|---|
| CN | 1079270 | A | 12/1993 |
| CN | 2228507 | Y | 6/1996 |
| JP | 01178613 | A | 7/1989 |
| KR | 10-0378382 | B1 | 3/2003 |
| KR | 10-2010-0117267 | A | 11/2010 |
| KR | 10-1018386 | B1 | 2/2011 |
| KR | 10-2012-0076806 | A | 7/2012 |
| KR | 10-2013-0023331 | A | 3/2013 |
| KR | 10-2010-0104052 | A | 9/2013 |

* cited by examiner

*Primary Examiner* — Kyle Armstrong
(74) *Attorney, Agent, or Firm* — Maschoff Brennan

(57) ABSTRACT

The present invention relates to an earth anchor and a construction method therefor, and is for facilitating the installation of a wale member and a head block member by using a pedestal member mounted on the outer surface of a retaining wall which is supported by the earth anchor, enabling the construction process to be simplified, thereby shortening construction time and reducing the amount of steel needed and construction costs.

16 Claims, 24 Drawing Sheets

Frior Art

EARTH ANCHOR AND CONSTRUCTION METHOD THEREFOR

TECHNICAL FIELD

The present invention relates to an earth anchor and a construction method therefor, and in particular to an earth anchor and a construction method therefor, wherein a structure for fixing an extension line at an outer portion of a soil retailing wall can be simplified.

BACKGROUND ART

A soil retaining temporal facility, in general, is directed to a temporal structure which is employed to support the ground in an effort to prevent any collapse of the ground during a ground excavation when it needs to construct an underground structure.

The soil retaining temporal facility may be constructed by any of a H-pile construction method which uses a common steel material, a construction method which uses an anchor, a pre-compression method which directly applies an axle force to a strut which is supporting an excavation ground, a construction method which applies a pre-stress to a wale, a construction method which applies a truss-type wale, etc.

The soil retaining wall which supports the ground in case of the soil retaining temporal facility is installed fixed by an earth anchor.

An end of the earth anchor is buried in the perforated ground and is fixed, and the other end thereof is fixed at an outer portion of the soil retaining wall, thus fixing the soil retaining wall in order for the ground to be supported.

Referring to FIGS. 1 and 2, the earth anchor 3 is inserted in a perforated hole 2*a* formed slanted downward at the ground 2, and the inserted one end thereof can be fixed by a grout 4 injected in the perforated hole 2*a*. Moreover, the other end of the earth anchor 3 passes through the soil retaining wall 1 which is supporting the ground and is fixed at an outer portion of the soil retaining wall 1. The earth anchor 3 includes a wale fixing part 5 which is formed of a plurality of extension lines 3*a* which are inserted in the perforated hole 2*a* of the ground 2, and a head block 3*b* wherein the extension lines 3*a* can be fixed outside the soil retaining wall 1. The wale fixing part 5 allows to install the head block 3*b* at the soil retaining wall 1.

Referring to FIG. 1, the wale fixing part 5 includes a wale 5*a* which is disposed spaced apart from each other above and below in the horizontal direction at the soil retaining wall 1, a beam hanger 5*b* which is able to support the wale 5*a*, a pair of the wales 5*a*, and a pedestal 5*c* both ends of which are connected to the wale 5*a*, wherein the head block 3*b* is mounted on the pedestal 5*c*. Moreover, there is provided a groove support 5*d* which is able to fill the space between the wale 5*a* and the soil retaining wall 1 by carrying out a groove filling procedure between the wale 5*a* and the soil retaining wall 1.

Referring to FIG. 2, the wale fixing part 5 includes a wale 5*a* which is disposed in the horizontal direction at the soil retaining wall 1 wherein the head block 3*b* is mounted on the wale 5*a*, and a beam hanger 5*b* which is able to support the wale 5*a*. Moreover, there is provided a groove support 5*d* which is able to fill the space between the wale 5*a* and the soil retaining wall 1 by carrying out a groove filling procedure between the wale 5*a* and the soil retaining wall 1.

More specifically, the earth anchor 3 is constructed in such a way that a beam hanger 5*b* is installed so as to fix the other end of the extension line 3*a* protruding outward of the soil retaining wall 1, and the wale 5*a* is installed thereon, and the groove filling procedure is carried out, and then the pedestal 5*c* is mounted.

In case of the conventional earth anchor 3, the procedure for fixing the extension line 3*a* from the outside of the soil retaining wall 1 is complicated, which may result in a lot of labor, and work time may increase, and the amount of steel materials required increases, thus increasing construction costs.

DISCLOSURE OF INVENTION

Technical Problem

Accordingly, it is an object of the present invention to provide an anchor and a construction method therefor, which is able to reduce labor since the installation of the anchor is easy, and a construction cost can be reduced.

Technical Solution

To achieve the above objects, there is provided an earth anchor which is installed in a perforated hole of the ground supported by a soil retaining wall and is configured to support the soil retaining wall, which may include, but is not limited to, a plurality of extension line members which are inserted in the perforated hole of the wall, wherein one end of both ends of each of the extension line members is exposed outward of the soil retaining wall;

a fixing part which is disposed in the perforated hole of the ground, wherein an end of each of the extension line members is fixed in the perforated hole;

a head block member which is configured to fix an end of each of the extension line member which is protruding outward of the soil retaining wall;

a wale member wherein the head block member is engaged; and a pedestal member which includes a wale fixing surface for fixing the wale member, and a fixing slanted surface which is formed slanted with respect to the wale fixing surface and is fixed on an outer side surface of the soil retaining wall.

Moreover, to achieve the above objects, there is provided a construction method for an earth anchor, which may include, but is not limited to, a step wherein the ground on which a soil retaining wall is constructed, is perforated; a step wherein an extension line member is inserted in the perforated hole formed on the ground; a step wherein a grout is injected and hardened in the perforated hole; a step wherein a wale member is disposed at an outer side of the soil retaining wall, and a pedestal member is disposed between the wale member and the soil retaining wall, and then the pedestal member is fixed;

a step wherein the wale member is fixed at the pedestal member; and a step wherein a head block member at which the extension line member is fixed, is engaged to the wale member.

Advantageous Effects of the Invention

According to the present invention, a construction work time can be reduced since a construction process is simplified in such a way to easily fix an end which is protruding outward of a soil retaining wall, by using a pedestal, and the amount of steel materials required and a construction cost can be reduced.

In the present invention, a tensioning work of an extension line can be stably carried out, by which a construction performance can be greatly improved.

Figure 1:
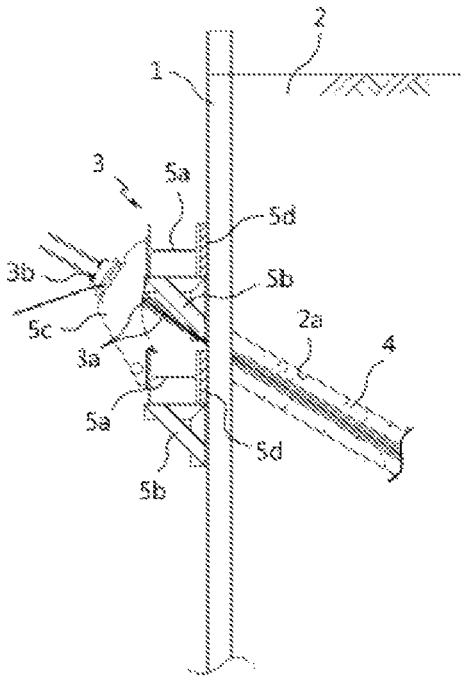
FIG. 1 is a schematic view illustrating an example of a conventional earth anchor.
Figure 2:
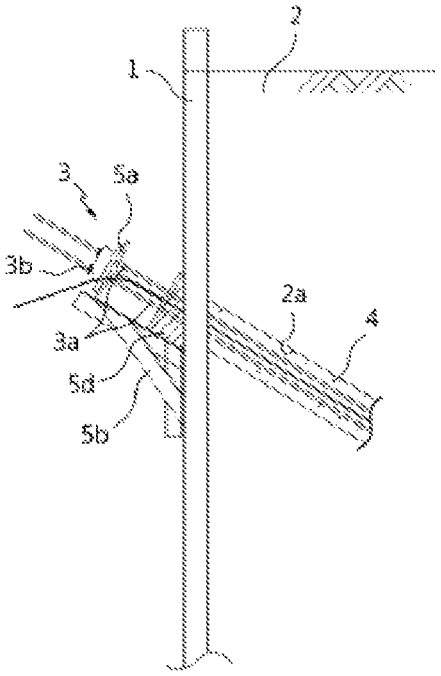
Prior Art FIG. 2
FIG. 2 is a schematic view illustrating another example of a conventional earth anchor.

*Legend of key reference numbers in the drawings

| | |
|---|---|
| 1: Soil retaining wall | 2: Ground |
| 10: Extension line member | 11: Steel wire part |
| 12: Coating part | 20: Fixing part |
| 30: Head block member | 31: Acupressure plate |
| 32: Block part | 40: Wale member |
| 41: First wale part | 42: Second wale part |
| 40a: Stomach part | 40b: Support part |
| 50: Pedestal member | 50a: Wale fixing surface |
| 50b: Fixing slanted surface | 50c: First pedestal protrusion part |
| 50d: Second pedestal protrusion part | |
| 51: First plate part | |
| 52: Second plate part | 53: Support plate part |
| 54: Third plate part | 55: Reinforcing plate part |
| 60: Spacing member | 61: Inner inserted structure |
| 70: Grout injection pipe member | |
| 71: Grout | |
| 80: Pedestal fixing frame | 81: Upper plate member |
| 81a: Fixing protrusion part | 82: Plate connection member |
| 82a: First connection fixing rod member | |
| 82b: Second connection fixing rod member | |
| 82c: Angle body | 83: Upper nut member |
| 84: Supporting plate member | 85: Lower nut member |
| 86: Lower plate member | 87: Guide member |
| 88: Assistant fixing member | 89: Plate fixing member |
| 90: Wale fixture | 91: Fixing plate member |
| 92: Cover plate member | 93: Wale fixing bolt member |
| 94: Wale fixing nut member | |

BEST MODES FOR CARRYING OUT THE INVENTION

The preferred embodiments of the present invention will be described with reference to the accompanying drawings.

Figure 3:
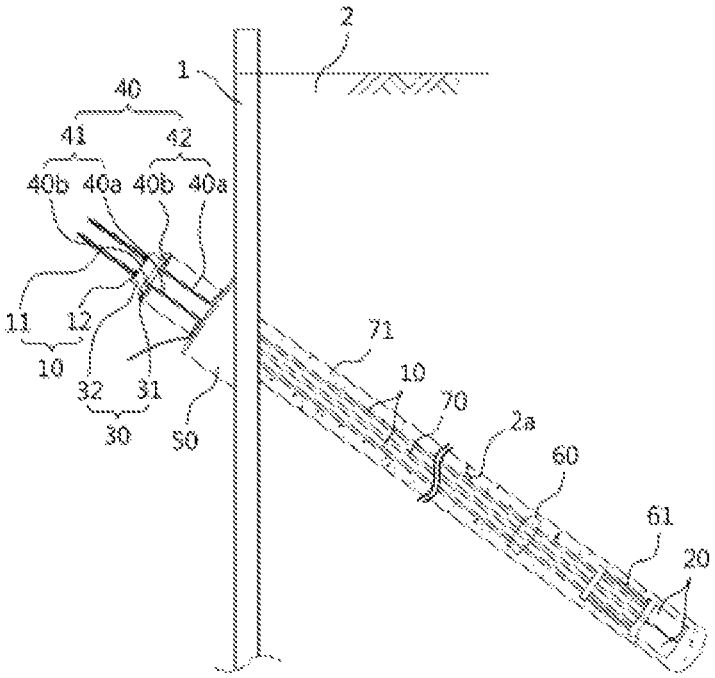
FIG. 3 is a schematic view illustrating an earth anchor according to the present invention.

Referring to FIG. 3, the earth anchor according to the present invention may be installed in the perforated hole 2*a* of the ground 2 which is supported on the soil retaining wall 1 and is able to support the soil retaining wall 1.

The soil retaining wall 1 may be installed on the wall surface of the excavated ground 2 and may support the ground 2, thus preventing the ground 2 from collapsing. The earth anchor is able to fixedly support the soil retaining wall 1 in order for the soil retaining wall 1 to support the ground 2.

The perforated hole 2*a* which is formed slanted downward, may be formed at the ground 2. The anchor is installed inserted in the perforated hole 2*a*.

The earth anchor may include a plurality of extension line members 10 which are inserted in the perforated hole 2*a* of the ground 2. The extension line member 10 may include a steel wire part 1, and a coating part 12 which is configured to cover the steel wire part 11. The steel wire part 11 may extend and pull the soil retaining wall 11 in the direction of the ground 2 based on a reactional force thereof, thus increasing the supporting force of the soil retaining wall 1.

The extension line member 10 may be inserted in the perforated hole 2*a* of the ground 2, wherein one of both ends may position at an inner portion in the perforated hole 2*a* of the ground 2, and the other one thereof may protrude outward of the soil retaining wall 1.

At an inner side of the perforated hole 2*a*, an end of the extension member 10 is fixedly connected to the fixing part 20. At one end thereof, the extension line member 10 may be connected to the inner inserted structure 61. More specifically, the extension line member 10 is connected passing through the inner inserted structure 61, wherein one end thereof is fixed at the fixing part 20.

Moreover, it is preferred that the earth anchor according to the present invention further includes a spacing member 60 which is inserted in the perforated hole 2*a* and is able to maintain the intervals of the extension line members 10 and allow a plurality of the extension line member 10 to be disposed in parallel.

Furthermore, the earth anchor according to the present invention may further include a grout injection pipe member 70 one end of which is inserted in the perforated hole 2*a*, and the other end of which is protruding outward of the soil retaining wall 1. The grout injection pipe member 70 is formed in a tubular shape or a hose shape and is provided to allow the grout 71 to be inserted in the perforated hole 2*a*. The grout 71 is injected and filled in the perforated hole 2*a* through the grout injection pipe member 70. The filled grout 71 is hardened, so the inner inserted structure 61 and the fixing part 20 can be fixed in the perforated hole 2*a*. The inner inserted part 61 may function as a hooking member in the hardened grout 71, thus more stably fixing one end of the extension line member 10 under the grout 71.

The other end of the extension line member 10 is protruding outward of the soil retaining wall 1 and is fixed at the head block member 30. The extension line member 10 passes through the head block member 30 and is fixed at the head block member 30 in a state where an end thereof is pulled and extended. The head block member 30 is fixedly engaged at the wale member 40, and the wale member 40 is disposed horizontal at the soil retaining wall 1. The wale member 40 may preferably include a first wale part 41 and a second wale part 42 which are disposed spaced apart from each other and define a predetermined space between them, wherein the extension line member 10 passes through the space.

As an example, the first wale part 41 and the second wale part 42 may be formed in a ⊏-shaped beam wherein a support part 40*b* is protruding toward one side from both ends of the stomach part 40*a*. The support parts 40*b* are disposed facing each other and are engaged mounted on the pedestal member 50.

The first wale part 41 and the second wale part 42 are the ⊏-shaped beams wherein the support part 40*b* is protruding from both ends of the stomach part 40*a*. One of the two support parts 40*b* may be engaged mounted on the pedestal member 50, and the head block member 40 may be engaged mounted on the other one of the two support parts 40*b*.

The first wale part 41 and the second wale part 42 are disposed spaced apart from each other in order for the support part 40*b* to orient outward and a plurality of the extension line members 10 to pass through and are fixedly mounted on the wale fixing surface 50*a* of the pedestal member 50.

The head block member 30 may include an acupressure plate 31 mounted on the wale member 40, and a block part 32 which is mounted on the acupressure plate 31 wherein the extension line member 10 passes through the block part 32 and then is fixed. The acupressure plate 31 is able to evenly distribute the load which occurs when the extension line member 10 fixed at the block part 32 is pulled, toward the first wale part 41 and the second wale part 42 and is able to allow the block part 32 to be stably supported between the first wale part 41 and the second wale part 42.

The pedestal member 50 has a wale fixing surface 50*a* at which the wale member 40 is fixed, and may be formed slanted with respect to the wale fixing surface 50*a* and may include a fixing slanted surface 50*b* which is fixed at the outer side surface of the soil retaining wall 1, so the pedestal member 50 can directly contact with the outer side surface of the soil retaining wall 1 and can be fixed. As an example, the pedestal member 50 can be fixedly welded at the outer side surface of the soil retaining wall 1.

Figure 4:
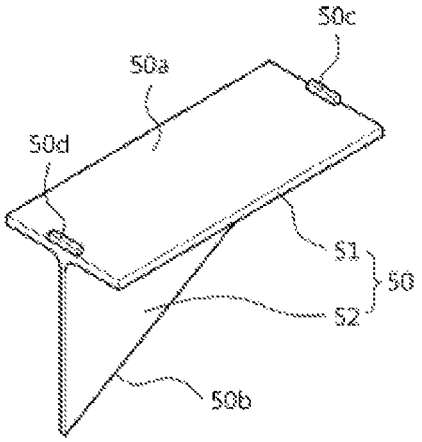
FIGS. 4 to 6 are views illustrating various embodiments of a pedestal member according to the present invention.
Figure 5:
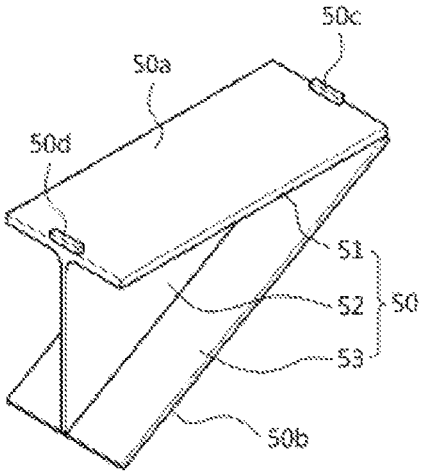
Figure 6:
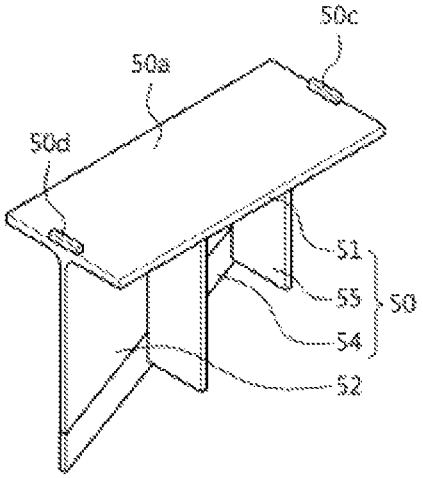

FIGS. 4 to 6 are views illustrating various embodiments of the pedestal member 50. Referring to FIGS. 4 to 6, it is preferred that a first pedestal protrusion part 50*c* can protrude from the wale fixing surface 50*a* of the pedestal member 50. The first pedestal protrusion part 50*c* may be provided at the upper side of the wale fixing surface 50*a* with respect to the widthwise direction of the wale member 40, whereby it can be hooked by the wale member 40 when the pedestal member 50 slides during the work wherein the pedestal member 50 is being fixed at the soil retaining wall 1, thus preventing the pedestal member 50 from sliding down from the wale member 40 during the work wherein it is being fixed to the soil retaining wall 1. Moreover, it is preferred that a second protrusion part 50*d* protrudes from the wale fixing surface 50*a* of the pedestal member 50 in a state where it is spaced apart from the first pedestal protrusion part 50*c*. The second pedestal protrusion part 50*d* is disposed at a lower portion of the wale fixing surface 50*a* in the widthwise direction of the wale member 40 which is mounted on the wale fixing surface 50*a* and may be hooked by the wale member 40 when the pedestal member 50 is moved upward during the work for fixing the pedestal member 50 at the soil retaining wall 1, whereby it is possible to prevent the wale member 40 from over separating from the wale fixing surface 50*a* during the work wherein the pedestal member 50 is fixed at the soil retaining wall 1.

The work for fixing the pedestal member 50 at the soil retaining wall 1 will be more specifically described later when describing the construction method of the anchor according to the present invention.

Referring to FIG. 4, the pedestal member 50 may include a first plate part 51 at an upper surface of which a wale fixing surface 50*a* is provided, wherein the wale member 40 is mounted on the wale fixing surface 50*a*, and a second plate part 52 which is fixed upright at the lower surface of the first plate part 51 and has the lower surface which is slanted upward or downward from one side to the other side. As an example, the slanted lower surface of the second plate part 52 corresponds to the fixing slanted surface 50*b*. The second plate part 52 has a tringle shape. As an example, it may have a right-angled triangle shape, wherein as an example, an inclined plane which is facing the right angle corresponds to the fixing slanted surface 50*b* fixed at the soil retaining wall 1, and the first plate part 51 may be mounted on the surface corresponding to the base side of the right angled triangle.

Referring to FIG. 5, the pedestal member 50 may further include a support plate part 53 which is fixedly disposed horizontal at a lower end portion of the second plate part 52.

The support plate part 53 may be fixed at a lower end portion of the second plate part 52 in order for the support plate part 53 to protrude toward both side surfaces of the second plate part 52, so the area supported by the soil retaining wall 1 of the second plate part 52 can be widened for the sake of a stable fixing. As an example, the slanted lower surface of the support plate part 53 is the fixing slanted surface 50*b*.

In an example wherein the second plate part 52 has a right angled triangle shape, the support plate part 53 may be fixedly fixed at the inclined plane which is facing the right angle.

Referring to FIG. 6, the pedestal member 50 may include a third plate part 54 which is fixed upright at a lower end portion of the second plate part 52 and has a lower surface which is slanted upward or downward from one side to the other side. It is obvious that the slope of the lower surface of the third plate part 54 may be same as or different from the slope of the lower surface of the second plate part 52.

The third plate part 54 is fixed upright at a lower end portion of the second plate part 52, so it can be easily and fixedly installed at the soil retaining wall 1 in such a way to adjust the height and slope angle of the second plate part 52. Moreover, it is preferred that the pedestal member 50 further includes a reinforcing plate part 55 which is disposed upright at both side surfaces of the second plate part 52 and is fixed at the second plate part 52 and the third plate part 54. In an example where the second plate part 52 is formed in a right angled triangle shape, the third plate part 54 is fixedly engaged at the inclined plane which is facing the right angle.

The reinforcing plate part 55 is preferably provided multiple in number spaced apart at both side surfaces of the second plate part 52, thus more reinforcing the strength of the connection portion between the second plate part 52 and the third plate part 54.

Figure 7:
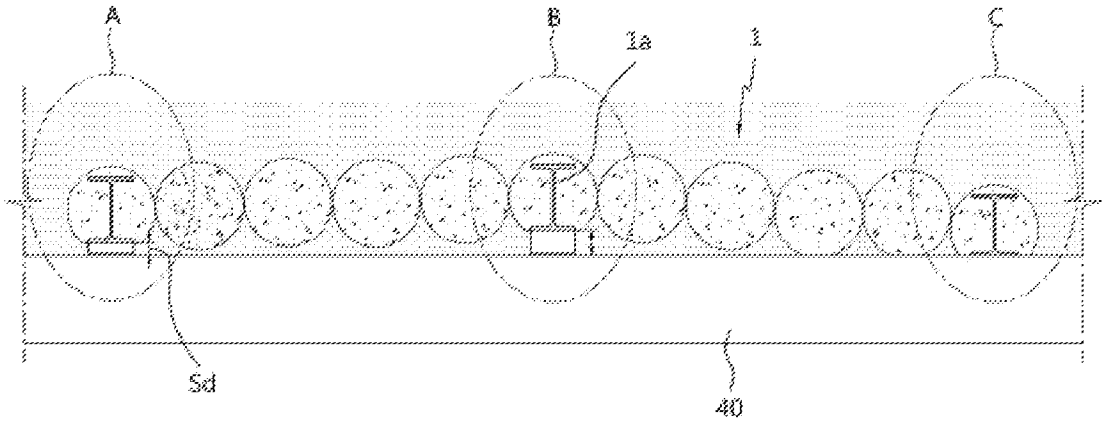
FIG. 7 is a plane view illustrating an example of a soil retaining wall.

FIG. 7 is a view illustrating an example of the soil retaining wall 1 which has been constructed by the C.I.P (Cast-In Placed Concrete Pile) construction method. The C.I.P construction method is directed to a construction method wherein the ground 2 is perforated at a predetermined depth using a predetermined excavation equipment, and a cylindrical casing is installed inserted in the perforated vertical hole, and a steel reinforcement, a coarse aggregate, a H-beam pile, etc. are inserted in the inside of the cylindrical casing, and the concrete pillars made in such a way to case concrete are continuously installed with the outer surfaces thereof contacting with each other.

Referring to FIG. 7, the outer side surface of the soil retaining wall 1 may be constructed uneven, not even in a straight shape. The flange of the H-beam 1*a* may be exposed from the concrete pillar in which the H-beam is inserted so as to fix the pedestal member 50 to the concrete pillar which has been made by the C.I.P (Cast-In-Placed Concrete Pile). The portions A, B and C in FIG. 7 correspond to the portions where the pedestal member 50 is fixed, in which the exposed engaging surface of the flange is disposed uneven. In the above configuration, it can be confirmed that the interval Sd is irregular between the wale member 40 and the soil retaining wall 1, which are disposed in a straight line shape in the horizontal direction.

If the engaging surface of the flange is formed uneven at the portions A, B and C, it is fixedly welded at the exposed flange, and if the engaging surface of the exposed flange is uneven, the wale member 40 is disposed like a straight line shape in the horizontal direction at a previously set installation position, and it is fixed at the soil retaining wall 1 by adjusting the position of the pedestal member 50.

Figure 8:
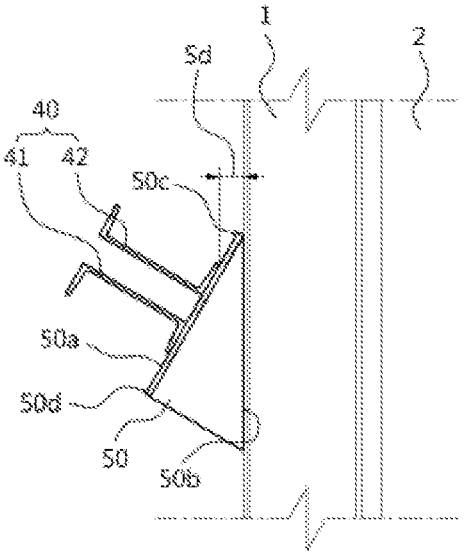
FIG. 8 is a view illustrating an example where a pedestal member in FIG. 7 is mounted.

In the conventional construction method, there has been an inconvenience since a groove filling work should be carried out so as to fix the wale member 40 in a straight like shape in the horizontal direction, but as illustrated in FIG. 8, the earth anchor of the present invention can be fixed in such a way that the wale member 40 is mounted on the wale fixing surface 50*a* of the pedestal member 50, and the wale member 40 mounted on the wale fixing surface 50*a* can be supported in a straight line shape while moving the pedestal member 50 in a state where the fixing slanted surface 50*b* of the pedestal member 50 contacts with the soil retaining wall 1. More specifically, the earth anchor according to the present invention can be fixed in such a way that the position of the wale member 40 is disposed at a normal position in a straight line shape, and the pedestal member 50 is moved outside the wale member 40 and the soil retaining wall 1, so the wale member 40 can be accurately mounted on the wale fixing surface 50*a* of the pedestal member 50. In the conventional construction method, it needs to carry out the groove filling work so as to fill the space between the wale member 40 and the soil retaining wall 1, but the earth anchor according to the present invention allows to fixedly engage the wale member 40 to the pedestal member 50 in such a way to dispose the wale member 40 at a normal position in a straight line shape without carrying out the groove filling work since in the present invention, it is possible to adjust the position of the wale member 40 which is fixed on the wale fixing surface 50*a* in such a way to move the triangular pedestal member 50.

Referring to FIGS. 9 to 25, it is preferred that the earth anchor according to the present invention may further include a pedestal fixing frame 80 which is able to engage the wale member 40 mounted on the wale fixing surface 50*a* and the pedestal member 50 and allows the pedestal member 50 to move in a state where they are engaged.

FIGS. 9 and 10, 12 and 13, 15 and 16, 18 and 19, 21 and 22, and 24 and 25 illustrate that the wale member 40 includes the first wale part 41 and the second wale part 42 which are disposed spaced apart from each other and define a space between them through which the extension line member 10 passes, and the first wale part 41 and the second wale part 42 are ⊏-shaped beams wherein the support part 40*b* is protruding from both ends of each stomach part 40*a*.

FIGS. 11, 14, 17 and 23 illustrate an example wherein the first wale part 41 and the second wale part 42 are H-shaped beams wherein the support part 40*b* is protruding toward both sides of the stomach part 40*a* at both ends of each stomach part 40*a*.

The first wale part 41 and the second wale part 42 have the shapes of a ⊏-shaped beam or a H-shaped beam, and they may have various beam shapes.

The pedestal fixing frame 80 may have an upper plate member 81 mounted on the top of the wale member 40, a supporting plate member 84 a part of which is hooked by the lower surface of the first plate part 51, and a plate connection member 82 which is able to connect in a separable state the upper plate part 81 and the supporting plate member 84.

Moreover, the pedestal fixing frame 80 may further include a lower plate member 86 which is disposed between the first wale part 41 and the second wale part 42, wherein both ends are protruding toward both sides in the widthwise direction of the first plate part 51, and the plate connection member 82 passes through both ends thereof. As an example, the lower plate member 86 is mounted on the wale fixing surface 50*a* of the first plate part 51, and the interval between the first wale part 41 and the second wale part 42 can be adjusted.

A guide member 87 protruding outward of both side ends of the first plate part 51 is provided at both lower sides of the lower plate part 86. The guide member 87 contacts with both side ends of the first plate part 51, and the fixedly engaged position can be easily adjusted in such a way that the pedestal member 50 smoothly moves straight along the first plate part 51 in a state where the wale 40 is mounted on the wale fixing surface 50*a* of the pedestal member 50 with the aid of the pedestal fixing frame 80.

Moreover, the guide member 87 has the same thickness as the first plate part 51 and fills the space between the supporting plate member 84 and the lower plate member 86, thus maintaining the supporting plate member 84 in a horizontal state, whereby the wale 40 can be stably and fixedly engaged.

As an example, the supporting plate member 84 may be formed in a rectangular plate shape having a hole through which the plate connection member 82 passes. It is preferred that at least one portion thereof is stably hooked in a horizontal state by the pedestal member 50. As an example, the supporting plate member 84 is hooked by the lower surface of the first plate part 51.

The plate connection member 82 is configured in such a way that a lower end thereof protrudes downward from both sides in the widthwise direction of the first plate part 51, by which the supporting plate member 84 can be engaged to the lower side thereof, and the lower surface of the first plate part 51 can be hooked.

Moreover, a fixing protrusion part 81*a* protruding from between the first wale part 41 and the second wale part 42 may be provided at the lower surface of the upper plate member 81.

The fixing protrusion part 81*a* is configured to fix the position of the upper plate member 81 which is hooked by the first wale part 41 or the second wale part 42 and is placed on the support part 40*b* at the upper sides of the first wale part 41 and the second wale part 42, and is able to prevent any accident wherein the upper plate member 81 slides and fells down during the installation work of the pedestal fixing frame 80.

The pedestal fixing frame 80 may allow to dispose the first and second wale members 40 and the first plate part 51 of the pedestal member 50 between the upper plate member 81 and the supporting plate member 84 and is able to maintain a state where the first wale part 41 and the second wale part 42 have been mounted on the wale fixing surface 50*a*.

The pedestal fixing frame 80 is provided to engage the wale member 40 mounted on the wale fixing surface 50*a* of the pedestal member 50, and the pedestal member 50, and may allow to move the pedestal member 50 in a state where they have been engaged.

The pedestal fixing frame 80 may be separated in a state where the pedestal member 50 has been fixed at the outer side surface of the soil retaining wall 1, and the wale member 40 has been fixed at the wale fixing surface 50*a* of the pedestal member 50, and can separate from the wale member 40 and the pedestal member 50.

The pedestal fixing frame 80 allows to easily move the pedestal member 50 in a state where the wale member 40 has been mounted on the wale fixing surface 50*a* and prevent any falling accident of the pedestal member 50 during the work. The pedestal fixing frame 80 also may allow the easier and stable installation work of the pedestal member 50 and the wale member 40.

Moreover, it is preferred that the earth anchor according to the present invention further includes a wale fixture 90 which is able to fix in a separable state the wale member 40 at the pedestal member 50.

The wale fixture 90 allows to fix the wale member 40 at the pedestal member 50 and separate the wale member 40 and the pedestal member 50 during the disassembling procedure of the soil retaining wall 1 for the sake of reuse.

The wale fixture 90 may include, but is not limited to, a fixing plate member 91 which is mounted on the pedestal member 50;

a cover plate member 92 at least a portion of which is overlapped with the fixing plate member 91, and another portion of which is overlapped with a portion of the lower side of the wale member 40;

a wale fixing bolt member 93 which is passing through the fixing plate member 91, and the cover plate member 92; and a fixing nut member 94 which is engaged to the wale fixing bolt member 93.

The fixing plate member 91 may be provided integral with the lower surface of the cover plate member 92 and may be formed in a protruding shape. The fixing plate member 91 may be separable from the cover plate and may have different thicknesses based on the thickness of the support part 40*b* of the first wale part 41 and the second wale part 42.

The fixing plate member 91 may have different thicknesses. An appropriate thickness corresponding to the thickness of the support part 40*b* of the first wale part 41 and the second wale part 42 can be selected and used.

The wale fixture 90 allow to fix the wale member 40 at the pedestal member 50 in such a way that the wale fixing bolt member 93 has passed through the cover plate member 92, the fixing plate member 91, and the pedestal member 50, and the wale fixing nut part 94 is engaged to an end portion of the wale fixing bolt member 93 in a state where a part of the cover plate member 92 has covered a part of the support part 40*b* by mounting the cover plate member 92 on the upper surface of the fixing plate member 91 in a state where the fixing plate member 92 has been mounted on the wale fixing surface 50*a*. Moreover, the wale fixture 90 may separate from the pedestal member 50 if the wale fixing nut member 94 is loosened and separated from the wale fixing bolt member 93, and the wale member 40 may be separable from the pedestal member 50.

The wale fixture 90 may be provided multiple in number and allows to stably fix the first wale part 41 and the second wale part 42 at the pedestal member 50. As an example, two wale fixtures 90 are provided at the side of the support part 40*b* of the first wale part 41, and two wale fixtures 90 are provided at the side of the support part 40*b* of the second wale part 42.

Referring to FIGS. 9 to 23, at least one end of both ends of the plate connection member 82 may be connected with a bolt to any of the upper plate member 81 and the supporting plate member 84, and the plate connection member 82 may include a first connection fixing rod member 82*a* and a second connection fixing rod member 82*b* which are disposed at both sides in the widthwise direction of the first plate part 51.

Since the first connection fixing rod member 82*a* and the second connection fixing rod member 82*b* which are configured to connect the upper plate member 81 and the supporting plate member 84, are disposed outside of the first plate part 51 in the widthwise direction of the first plate part 51, the position thereof can be adjusted by moving the pedestal member 50 in a state where the first wale part 41 and the second wale part 42 are mounted on the wale fixing surface 50*a*.

The plate connection member 82 is able to connect the upper plate member 81 and the supporting plate member 84 through a bolt engagement and allows to stable fix the first wale part 41 and the second wale part 42 by pressurizing them between the upper plate member 81 and the first plate member 84.

Referring to FIGS. 9 to 17, the first connection fixing rod member 82*a* and the second connection fixing rod member 82*b* are disposed between the first wale part 41 and the second wale part 42 and may connect the upper plate member 81 and the supporting plate member 84.

Figure 9:
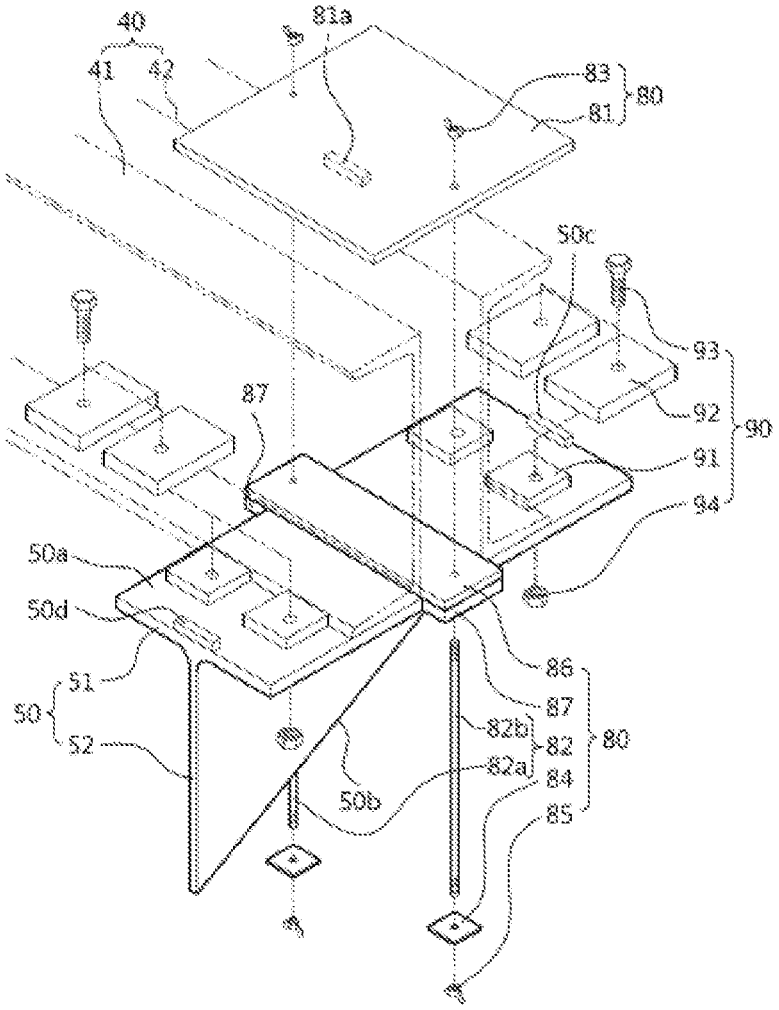
FIGS. 9 to 11 are views illustrating an example of a pedestal fixing frame according to the present invention.
Figure 10:
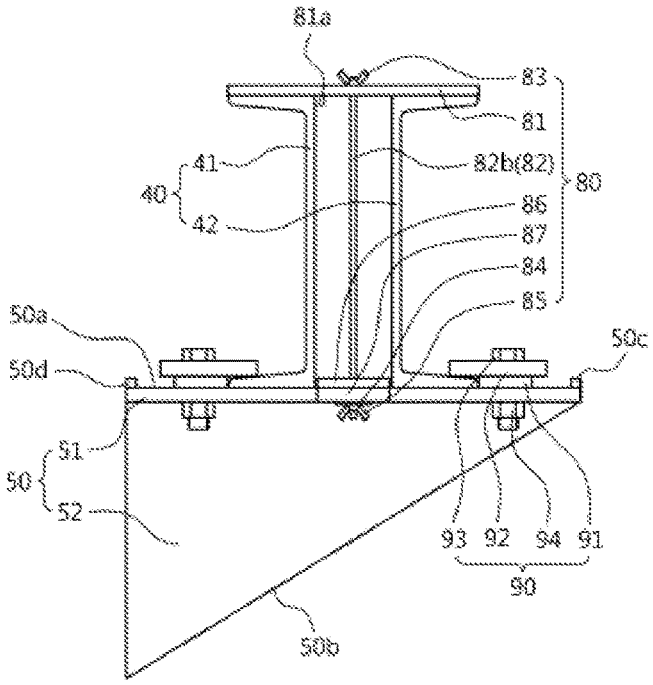
Figure 11:
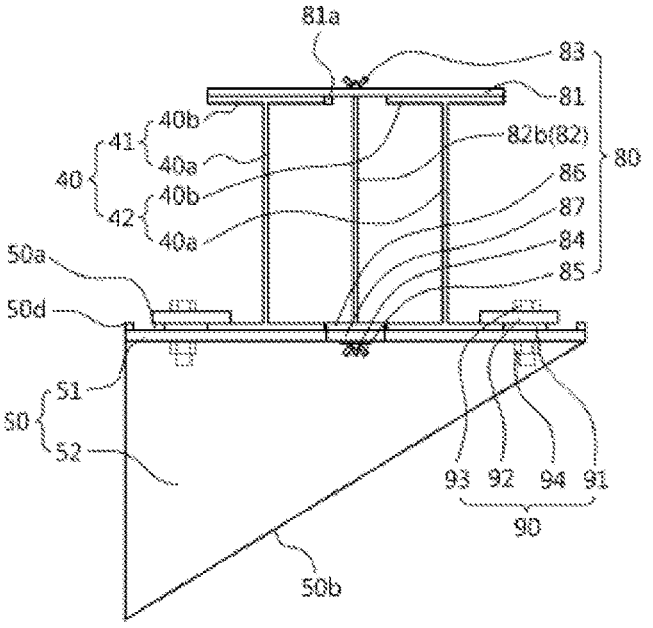

Referring to FIGS. 9 to 11, the embodiments of the first connection fixing rod member 82*a* and the second connection fixing rod member 82*b* will be described below.

Both ends of each of the first connection fixing rod member 82*a* and the second connection fixing rod member 82*b* pass through the upper plate member 81 and the supporting plate member 84, and the upper nut member 83 and the lower nut member 85 are engaged to both ends of each of them, whereupon the positions of the upper plate member 81 and the supporting plate member 84 can be fixed on the upper surface of the first plate part 51.

In this case, the threads to which the upper nut member 83 are engaged, may be formed at the upper ends of the first connection rod member 82*a* and the second connection fixing rod member 82*b*, and the threads to which the lower nut member 85 are engaged, may be formed at the lower ends of the first connection fixing rod member 82*a* and the second connection fixing rod member 82*b*.

Figure 12:
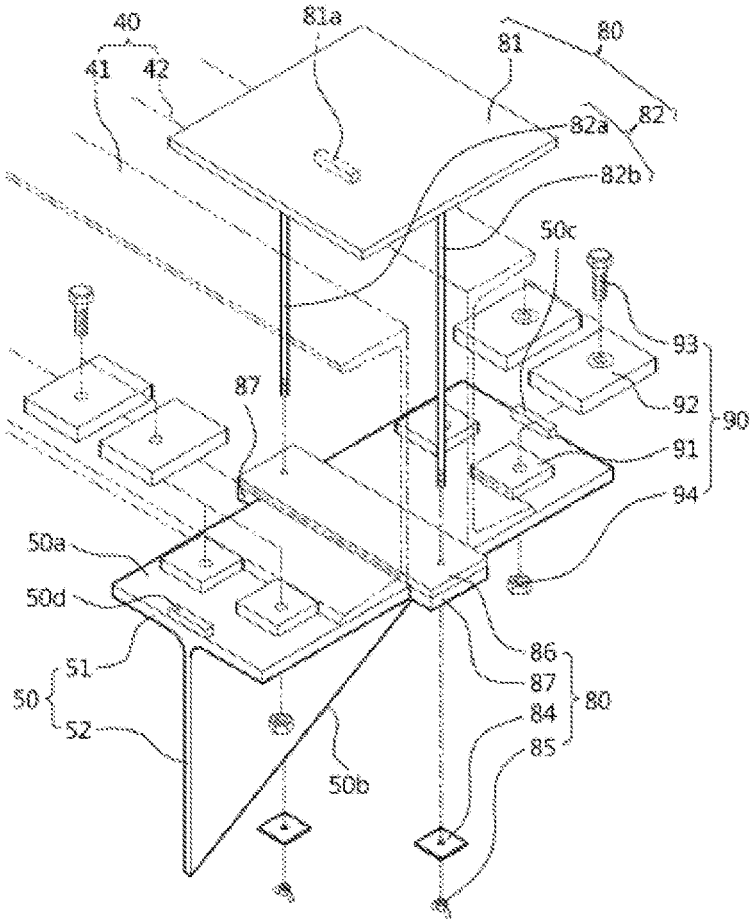
FIGS. 12 to 14 are views illustrating another example of a pedestal fixing frame according to the present invention.
Figure 13:
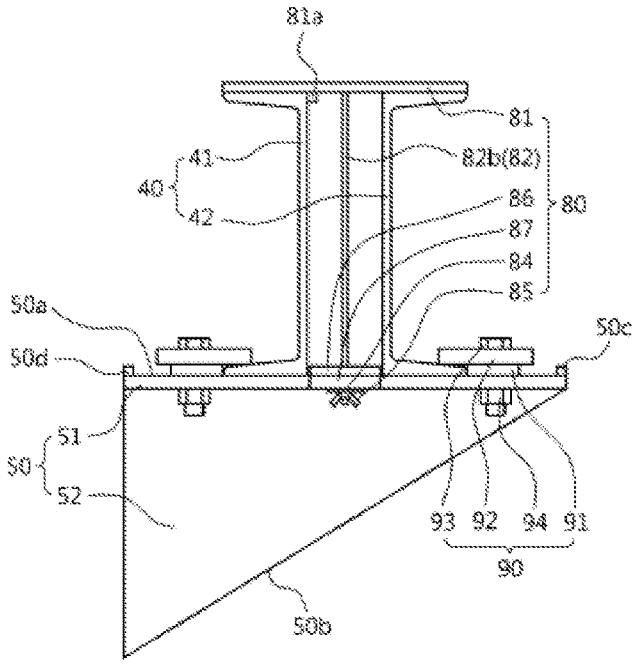
Figure 14:
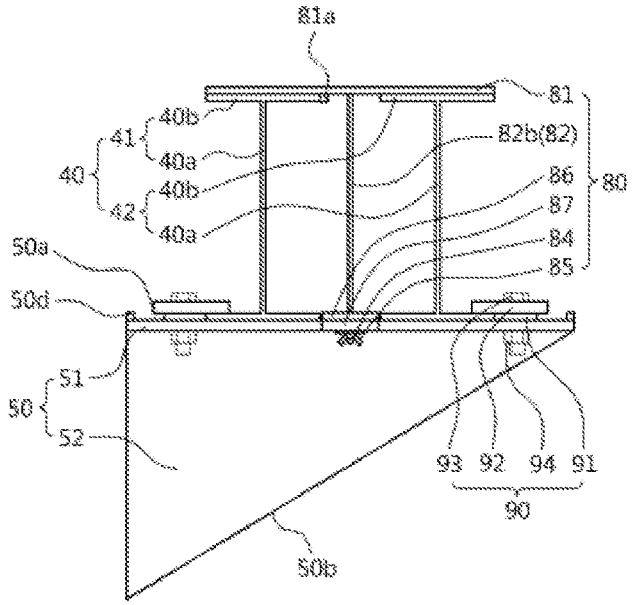

Referring to FIGS. 12 to 14, the embodiments of the first connection fixing rod member 82*a* and the second connection fixing rod member 82*b* will be specifically described below.

The upper end of each of the first connection fixing rod member 82*a* and the second connection fixing rod member 82*b* is fixed at the upper plate member 81, and the lower end of each of them passes through the supporting plate member 84, and the lower nut member 85 is engaged thereto, whereupon the positions of the upper plate member 81 and the supporting plate member 84 can be fixed on the upper surface of the first plate part 51.

In this case, the threads to which the lower nut member 85 is engaged, may be formed at the lower ends of the first connection fixing rod member 82*a* and the second connection fixing rod member 82*b*.

Figure 15:
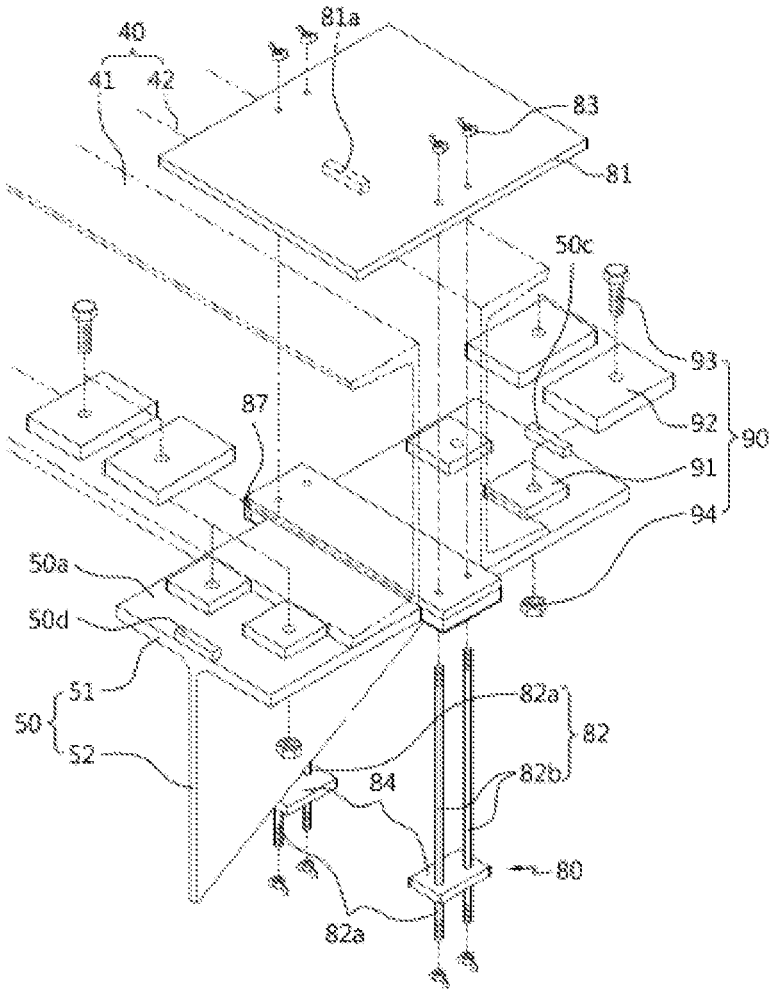
FIGS. 15 to 17 are views illustrating further another example of a pedestal fixing frame according to the present invention.
Figure 16:
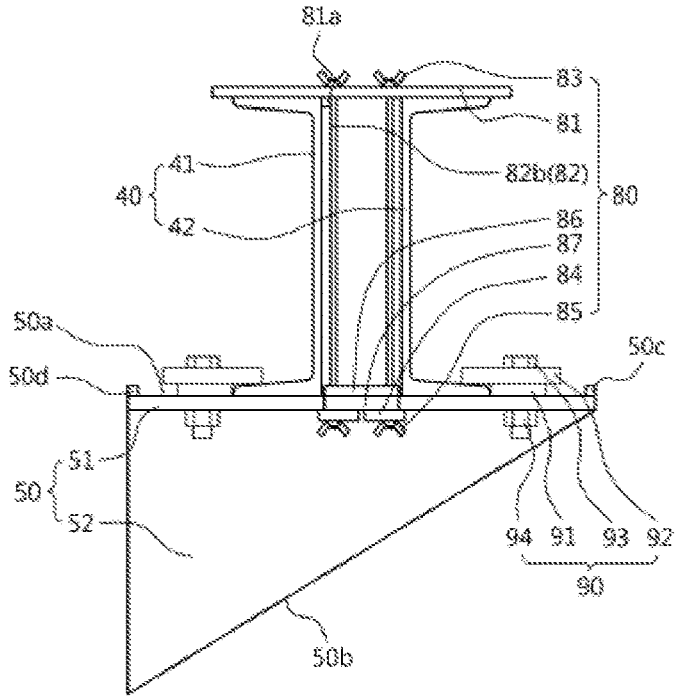
Figure 17:
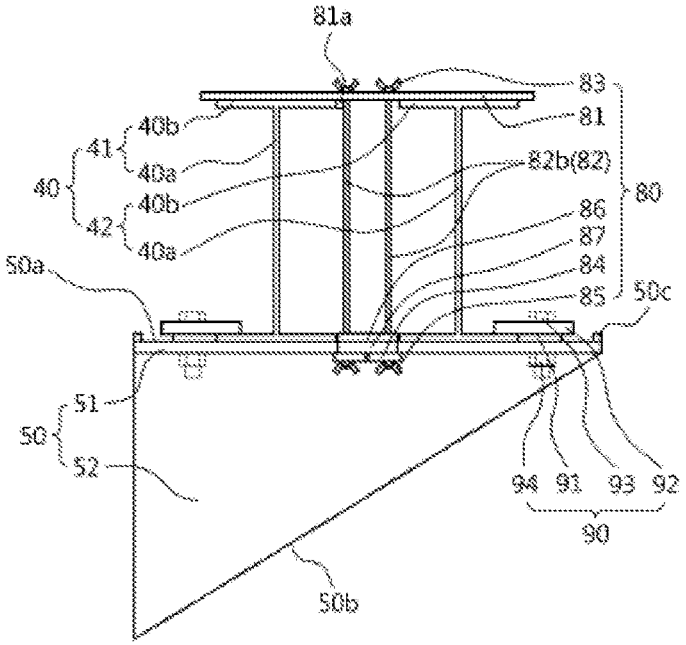

Referring to FIGS. 15 to 17, the embodiments of the first connection fixing rod member 82*a* and the second connection fixing rod member 82*b* will be more specifically described below.

The first connection fixing rod member 82*a* and the second connection fixing rod member 82*b* may be provided multiple in number between the first wale part 41 and the second wale part 42, and a plurality of the first connection fixing rod members 82*a* and a plurality of the second connection fixing rod members 82*b* may pass through the supporting plate member 84.

Referring to FIGS. 18 to 23, the first connection fixing rod member 82*a* and the second connection fixing rod member 82*b* may be disposed outside of both sides in the widthwise directions of the first wale part 41 and the second wale part 42.

At one side of the widthwise direction of the first plate part 51, the first connection fixing rod member 82*a* may be disposed outside of both sides in the widthwise directions of the first wale part 41 and the second wale part 42.

Moreover, at the other side of the widthwise direction of the first plate part 51, the second connection fixing rod member 82*b* may be disposed outside of both sides in the widthwise direction of the first wale part 41 and the second wale part 42.

The first connection fixing rod member 82*a* or the first connection fixing rod member 82*a* may pass through both ends of the supporting plate member 84, and the supporting plate member 84 may be preferably connected to the lower plate member 86 and the assistant fixing member 88.

The assistant fixing member 88 may include an assistant connection bolt 88*a* which is passing through the lower plate member 86 and the supporting plate member 84, and an assistant connection nut 88*b* which is engaged to the assistant connection bolt 88*a*.

The assistant fixing member 88 is configured to integrally connect the lower plate member 86 to the supporting plate member 84, thus fixing the position of the lower plate member 86. As an example, the assistant connection bolt 88*a* is passing through the lower plate member 86, the guide member 87 and the supporting plate member 84, and the assistant connection nut 88*b* is engaged to an end of the assistant connection bolt 88*a*.

Figure 18:
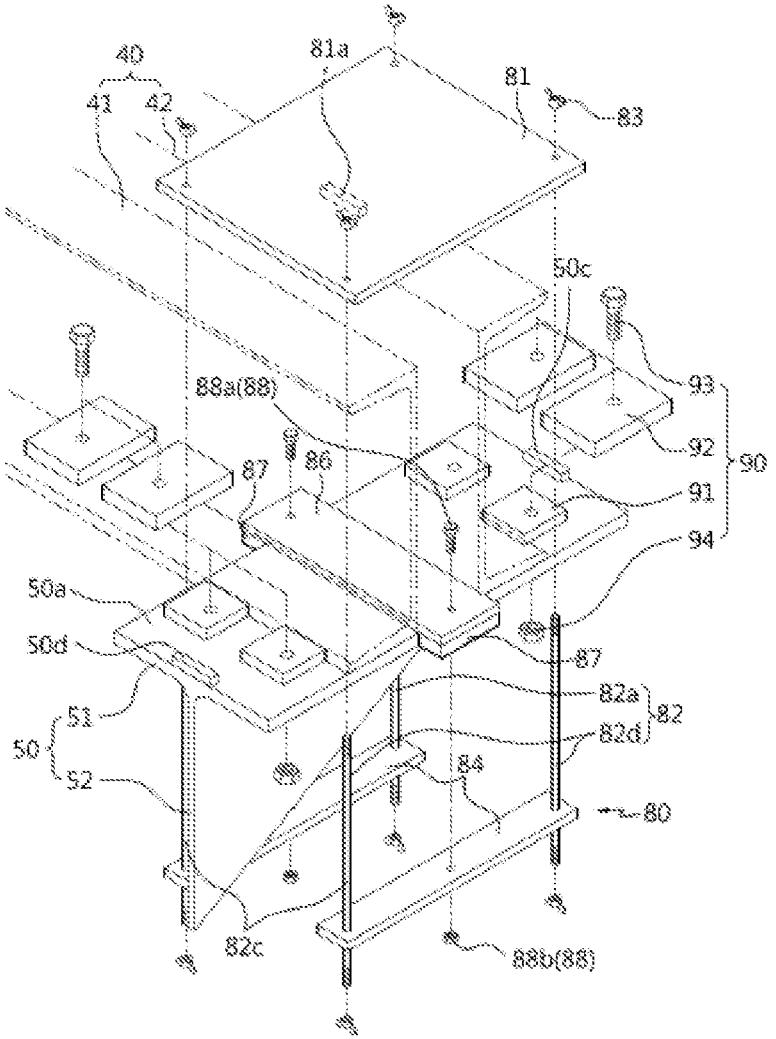
FIGS. 18 to 20 are views illustrating still further another example of a pedestal fixing frame according to the present invention.
Figure 19:
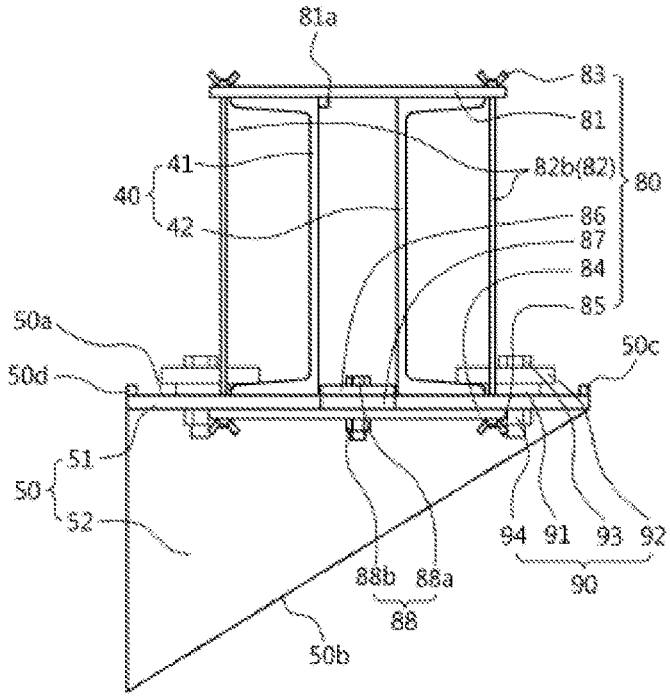
Figure 20:
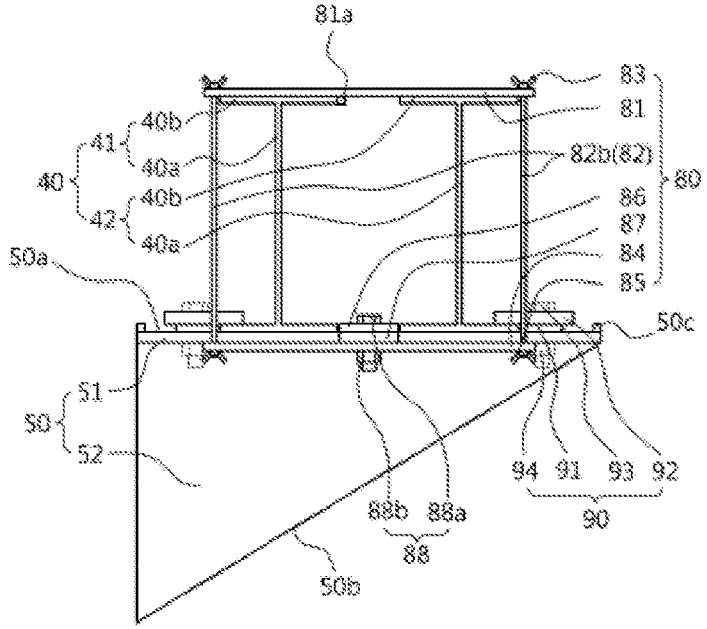

Referring to FIGS. 18 to 20, the embodiments of the first connection fixing rod member 82*a* and the second connection fixing rod member 82*b* will be described below.

Both ends of the first connection rod member 82*a* and the second connection fixing rod member 82*b* are passing through the upper plate member 81 and the supporting plate member 84, and the upper nut member 83 and the lower nut member 85 are engaged to both ends thereof, whereby the positions of the upper plate member 81 and the supporting plate member 84 can be fixed on the upper surface of the first plate part 51.

In this case, the threads to which the upper nut member 83 is engaged, are formed at the upper ends of the first connection fixing rod member 82*a* and the second connection fixing rod member 82*b*, and the threads to which the lower nut member 85 is engaged, are formed at the lower ends of the first connection fixing rod member 82*a* and the second connection fixing rod member 82*b*.

Figure 21:
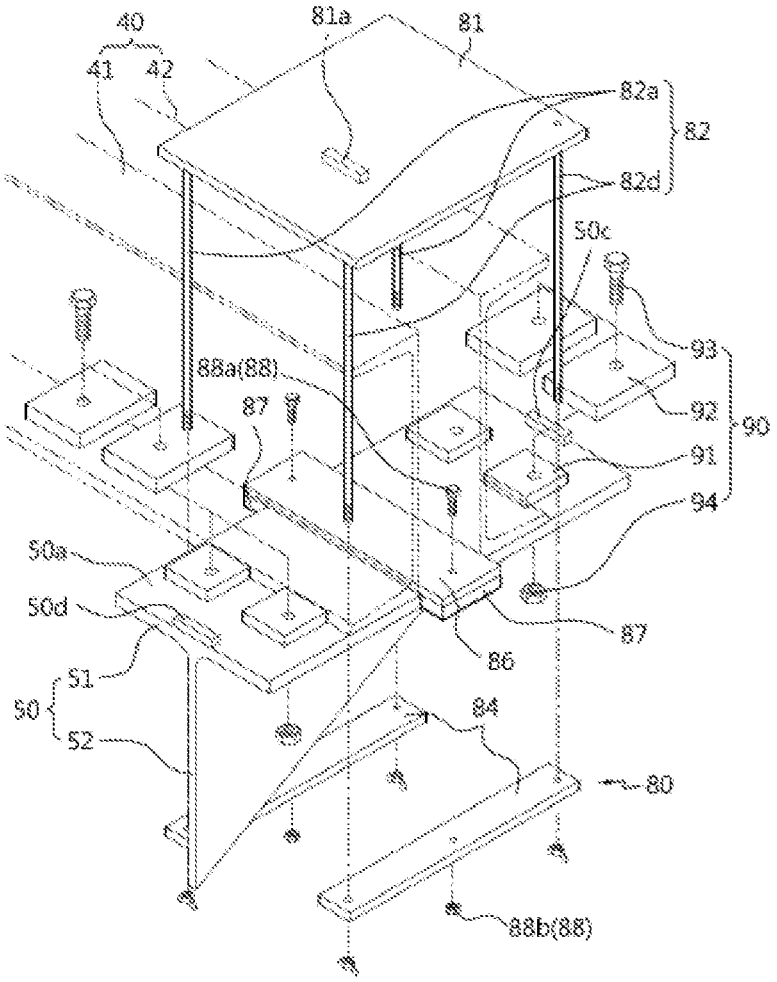
FIGS. 21 to 23 are views illustrating still further another example of a pedestal fixing frame according to the present invention.
Figure 22:
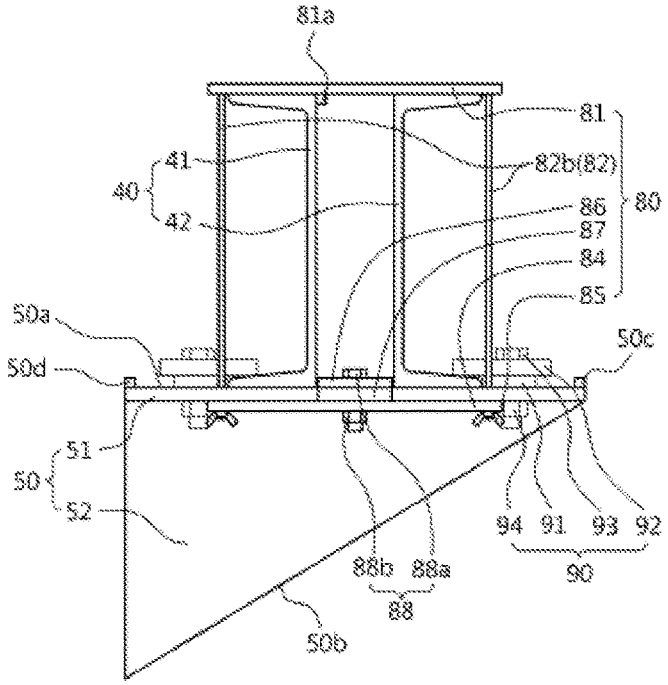
Figure 23:
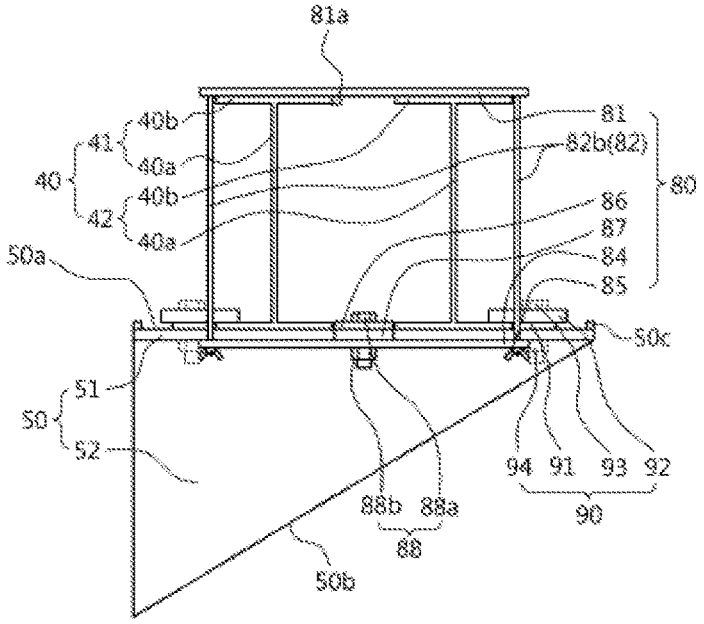

Referring to FIGS. 21 to 23, the embodiments of the first connection fixing rod member 82*a* and the second connection fixing rod member 82*b* will be described below.

The upper ends of the first connection fixing rod member 82*a* and the second connection fixing rod member 82*b* are fixed at the upper plate member 81, and the lower ends thereof are passing through the supporting plate member 84, and the lower nut member 85 is engaged thereto, whereupon the positions of the upper plate member 81 and the supporting plate member 84 can be fixed on the upper surface of the first plate part 51.

In this case, the threads to which the lower nut member 85 is engaged, may be formed at the lower ends of the first connection fixing rod member 82*a* and the second connection fixing rod member 82*b*.

Figure 24:
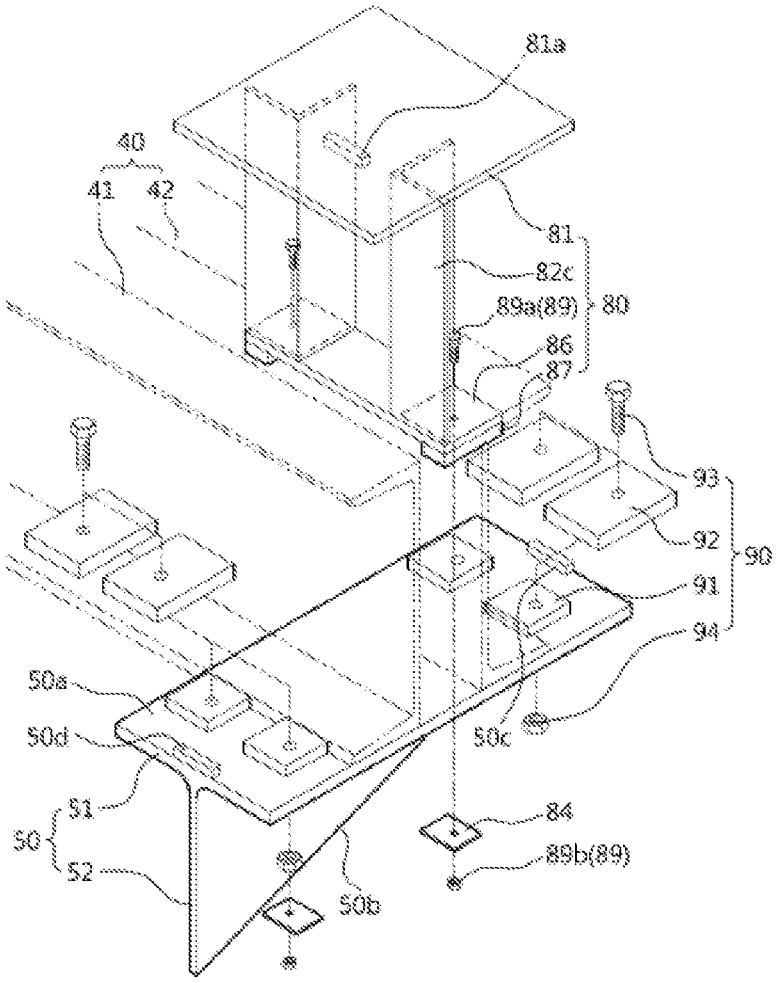
FIGS. 24 and 25 are views illustrating still further another example of a pedestal fixing frame according to the present invention.
Figure 25:
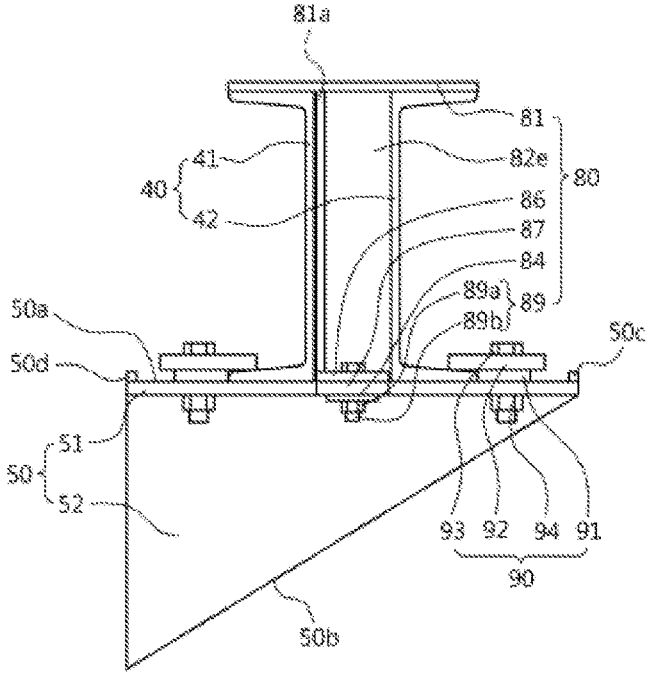
Figure 26:
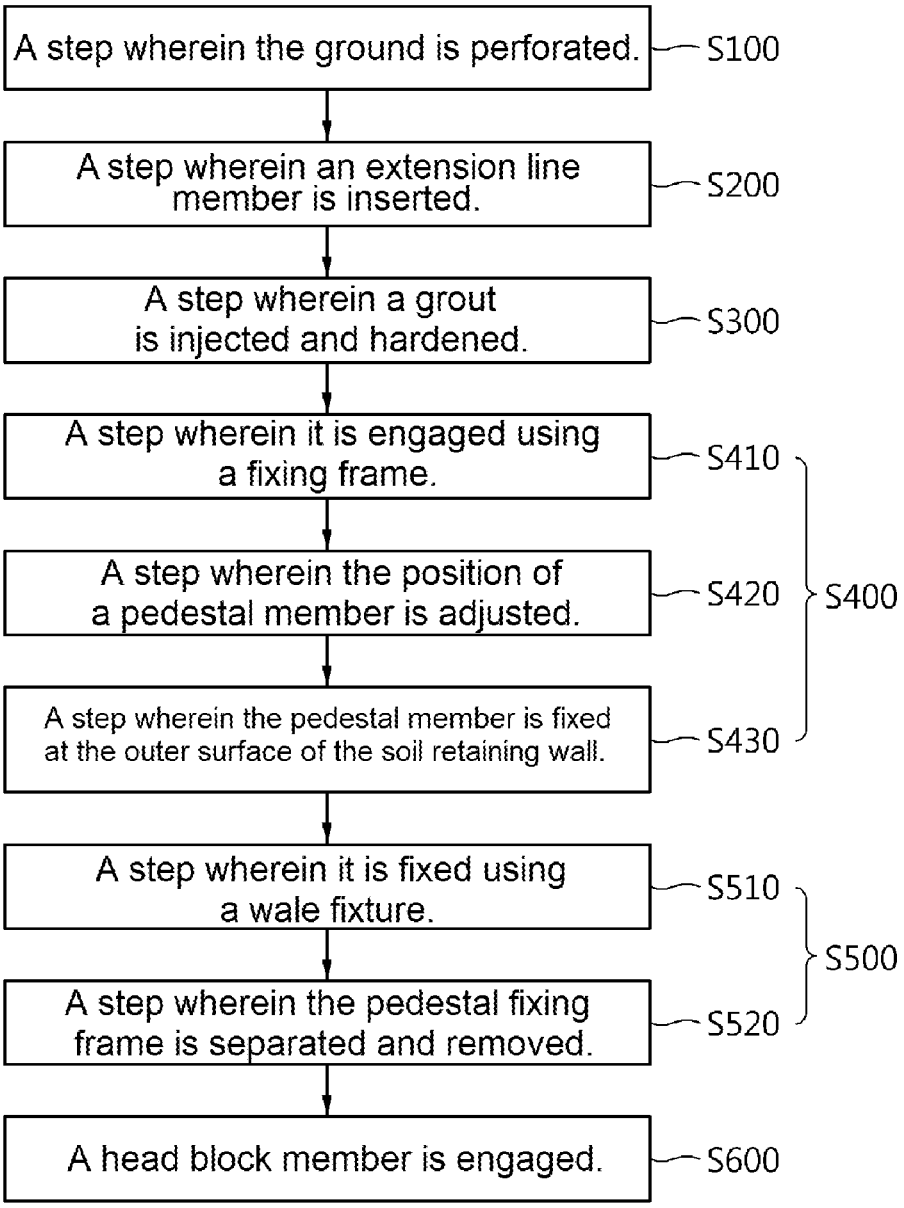
FIG. 26 is a block diagram for describing an earth anchor construction method according to the present invention.
Figure 27:
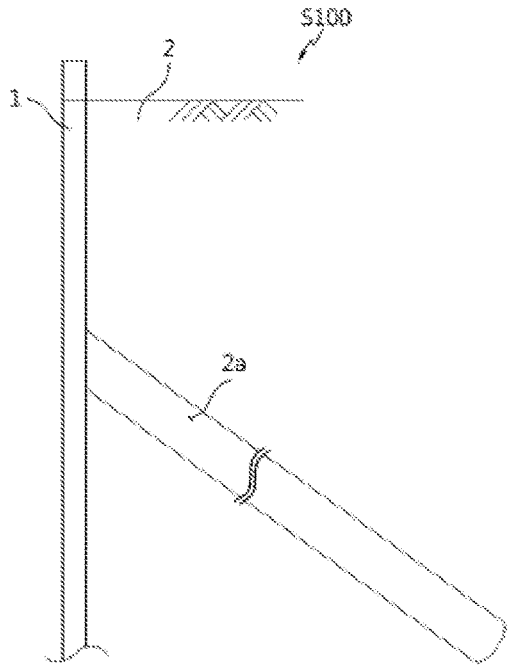
FIGS. 27 to 32 illustrating schematic views illustrating an earth anchor construction method according to the present invention.
Figure 28:
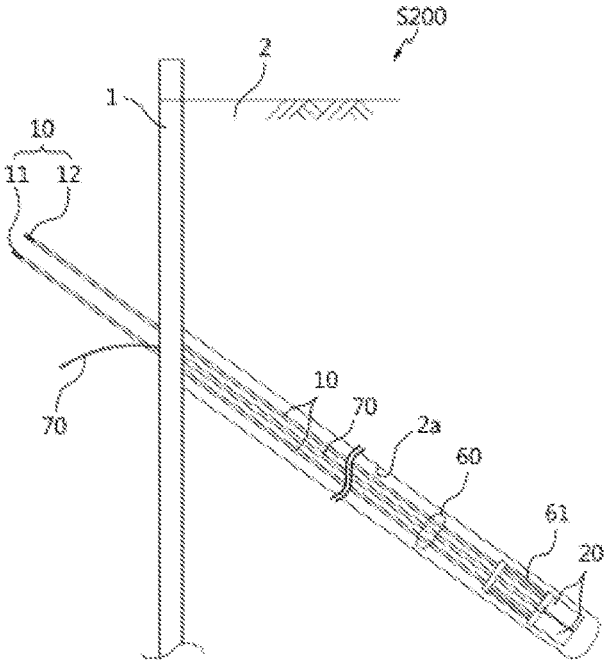
Figure 29:
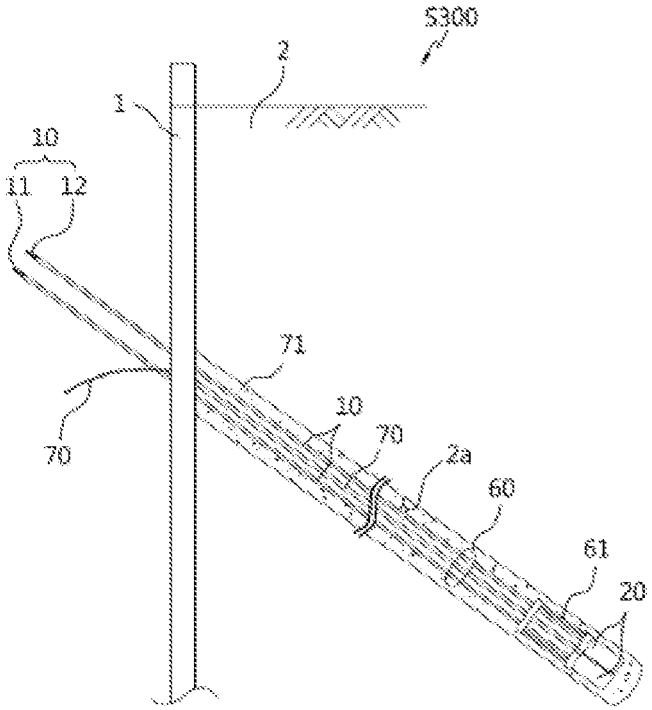
Figure 30:
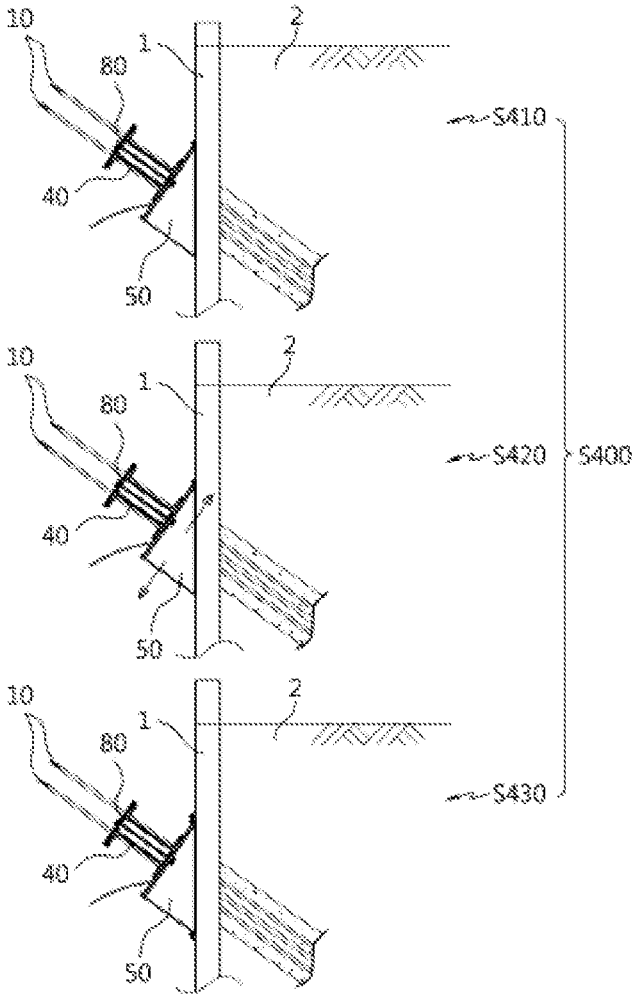
Figure 31:
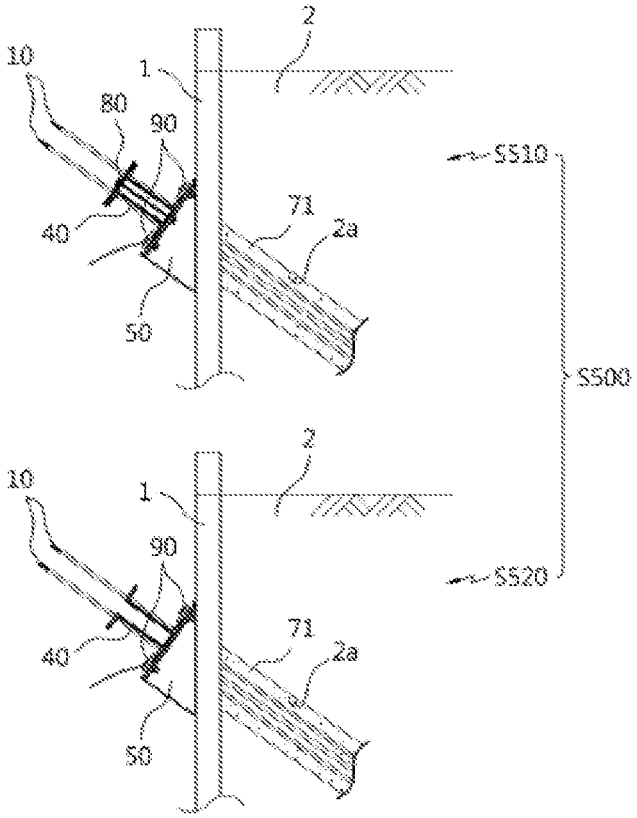
Figure 32:
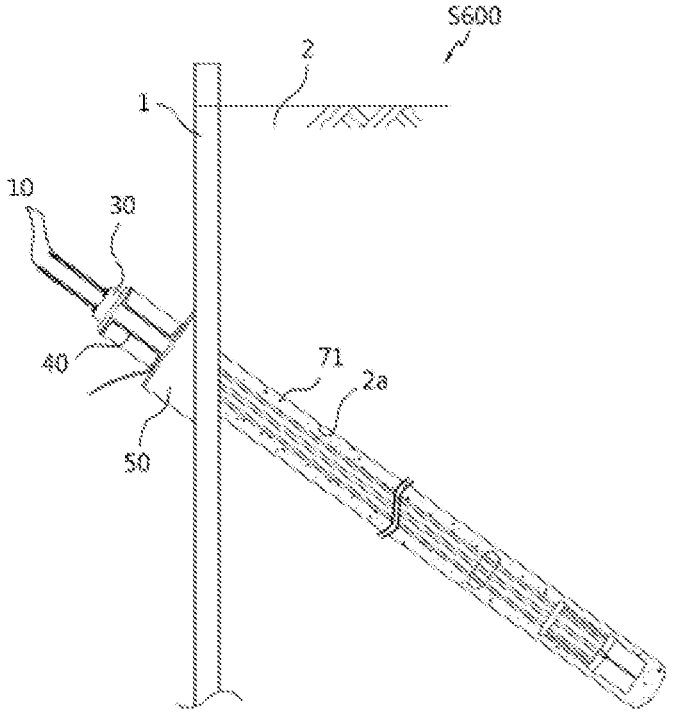

Referring to FIGS. 24 and 25, at least one end of both ends of the plate connection member 82 may be fixed at any of the upper plate member 81 and the supporting plate member 84, and the plate connection member 82 may include an angle body 82*c* which is connected to the other one via a bolt engagement.

The angle body 82*c* is disposed between the first wale part 41 and the second wale part 42 and is able to connect in a separable state the upper plate member 81 and the supporting plate member 84.

As an example, the angle body 82*c* may include a L-shaped angle or a ⊏-shaped angle and is disposed upright in a vertical direction, wherein the upper end thereof is fixed at the lower surface of the upper plate member 81, and the lower end thereof is connected to connect in a separable state the supporting plate member 84.

The L-shaped angle is an angle which is disposed upright in a vertical direction, wherein the vertical cross section thereof is L-shaped, and the ⊏-shaped angle is an angle which is disposed upright in a vertical direction, wherein the vertical cross section is ⊏-shaped, and an open part is formed at one side thereof, and a connection portion to the supporting plate member 84 is exposed in the direction of the open part, thus increasing convenience during a connection work. Moreover, between the first wale 41 and the second wale part 42, at least one surface of the L-shaped angle or the ⊏-shaped angle contacts with any of the vertical surface of the first wale part 41 and the vertical surface of the second wale part 42, and the other surface thereof is disposed crossing the space between the first wale part 41 and the second wale part 42, thus maintaining the space between the first wale part 41 and the second wale part 42, whereby the first wale part 41 and the second wale part 42 can be engaged stable to the pedestal member 50.

The lower end of the angle body 82*c* is fixed at the lower plate member 86, and the pedestal fixing frame 80 may further include the plate fixing member 89 which is able to connect in a separable state the lower plate member 86 and the supporting plate part 84.

The plate fixing member 89 may include a plate fixing bolt 89*a* which is passing through the lower plate member 86 and the supporting plate member 84, and a plate fixing nut 89*b* which is engaged to the plate fixing bolt 89*a*.

The plate fixing member 89 is able to integrally connect the lower plate member 86 to the supporting plate member 84, thus fixing the position of the lower plate member 86. As an example, the plate fixing bolt 89*a* is passing through the lower plate member 86, the guide member 87 and the supporting plate member 84, and the plate fixing nut 89*b* is engaged to the end thereof.

The construction method for an earth anchor according to the present invention will be described below.

Referring to FIGS. 26 and 27 to 32, the construction method for an earth anchor according to the present invention may include, but is not limited to, a step S100 wherein the ground 2 on which a soil retaining wall 1 is constructed, is perforated; a step S200 wherein an extension line member 10 is inserted in the perforated hole 2*a* formed on the ground 2; a step S300 wherein a grout 71 is injected and hardened in the perforated hole 2*a*; a step S400 wherein a wale member 40 is disposed at an outer side of the soil retaining wall 1, and a pedestal member 50 is disposed between the wale member 40 and the soil retaining wall 1, and then the pedestal member 50 is fixed; a step S500 wherein the wale member 40 is fixed at the pedestal member 50; and a step S600 wherein a head block member 30 at which the extension line member 10 is fixed, is engaged to the wale member 40.

In the step S200 for inserting the extension line member 10, a plurality of the extension line members 10 are inserted. The extension line member 10 is inserted in such a way that a part of one end of the extension line member 10 protrudes from an outer side of the perforated hole 2*a*, more specifically, protrudes outward of the soil retaining wall 1. Moreover, the inner inserted structure 61 and the fixing part 20 may be provided at an end of the extension line member 10 which is inserted into the perforated hole 2*a*. Furthermore, in the step S200 for inserting the extension line member 10, it is preferred that the spaces between the extension line members 10 are maintained in such a way to engage the spacer member 60 to a plurality of the extension line members 10 which have been inserted in the perforated hole 2*a*. Since the embodiments of the inner inserted structure 61, the fixing part 20 and the spacer member 60 have been described above, the descriptions thereof will be omitted so as to avoid duplicated descriptions.

In the step S200 for inserting the extension line member 10, the grout injection pipe member 70 which allows to inject the grout 71 into the perforated hole 2*a*, may be inserted together with the extension line member 10. In the step S300 for injecting and hardening the grout 71, the grout 71 may be injected and filled into the perforated hole 2*a* through the grout injection pipe member 70.

As an example, the pedestal member 50 is triangular. Since the embodiment of the pedestal member 50 has been described above, the description thereof will be omitted so as to avoid duplicated descriptions.

As an example, the wale member 40 may be lifted up by a crane in a state where the first wale part 41 and the second wale part 42 have been connected by a separate connection body and may be disposed at a previously set position.

The step S400 for fixing the pedestal member 50 may include, but is not limited to, a step S410 wherein the wale member 40 is mounted on a wale fixing surface 50*a* of the pedestal member 50, and the wale member 40 and the pedestal member 50 are engaged using the pedestal fixing frame 80; a step S420 wherein the position of the pedestal member 50 is adjusted in such a way to move the pedestal member 50 engaged to the wale member 40 using the pedestal fixing frame 80 in a state where the pedestal member 50 is contacting with the outer surface of the soil retaining wall 1; and a step S430 wherein the pedestal member 50 the position of which has been determined, is fixed at the outer surface of the soil retaining wall 1.

In the step S420 for adjusting the position of the pedestal member 50, the engaging position of the pedestal member 50 and the engaging position of the wale member 40 with respect to the pedestal member 50 can be determined in such a way to move the pedestal member 50 based on the space between the wale member 40 and the engaging surface of the soil retaining wall 1.

As an example, the pedestal member 50 may be fixedly welded at the outer surface of the soil retaining wall 1.

The pedestal fixing frame 80 may allow the pedestal member 50 to move in a state where the wale member 40 and the pedestal member 50 have been engaged. Since the embodiment of the pedestal fixing frame 80 has been described above, the description thereof will be omitted so as to avoid duplicated descriptions.

The step S400 for fixing the wale member 40 to the pedestal member 50 may include, but is not limited to, a step S510 wherein the wale member 40 is fixed separable at the pedestal member 50 using a wale fixture 90; and a step S520 wherein the pedestal fixing frame 80 is separated and removed.

The wale fixture 90 is configured to fix in a separable state the wale member 40 at the pedestal member 50. Since the embodiment of the wale fixture 90 has been described above, the description thereof will be omitted so as to avoid duplicated descriptions.

In the step S600 for engaging the head block member 30, an end of the extension line member 10 is passed through the head block member 30 and is exposed, and the steel wire part 11 beneath the coating part 12 is pulled out from the exposed end of the extension line, thus providing the extension line member 10 with a predetermined tensile force, and then the extension line member 10 is fixed at the head block member 30.

In the present invention, since an end protruding outward of the soil retaining wall 1 can be stably fixed using one pedestal, the construction procedure can be simplified, and the construction work time can be shortened, and the amount of steel materials required and the construction cost can be saved.

In the present invention, the tensioning work of the extension line can be stably carried out, thus greatly improving constructability.

The present invention is not limited to the above embodiments, and it is obvious that the present invention can be variously modified and implemented without departing from the concept of the present invention, which belongs to the range of the present invention.

The invention claimed is:

1. An earth anchor which is installed in a perforated hole of the ground supported by a soil retaining wall and is configured to support the soil retaining wall, comprising:

a plurality of extension line members which are inserted in the perforated hole of the wall, wherein one end of both ends of each of the extension line members is exposed outward of the soil retaining wall;

a fixing part which is disposed in the perforated hole of the ground, wherein an end of each of the extension line members is fixed in the perforated hole;

a head block member which is configured to fix an end of each of the extension line member which is protruding outward of the soil retaining wall;

a wale member engaged with the head block member; and a pedestal member which includes a wale fixing surface for fixing the wale member, and a fixing slanted surface which is formed slanted with respect to the wale fixing surface and is fixed on an outer side surface of the soil retaining wall, wherein the pedestal member includes a first plate part which has, on its upper surface, a wale fixing surface on which the wale member is mounted; and a second plate part which is fixed upright in a vertical direction on the lower surface of the first plate part and includes the lower surface which is slanted upward or downward from one side to the other side, wherein the wale member includes a first wale part and a second wale part which are disposed spaced apart from each other and form a space through which the extension line member passes, a pedestal fixing frame which is configured to engage the wale member mounted on the wale fixing surface, and the pedestal member and allow the pedestal member to be movable in a state where they are engaged, wherein the pedestal fixing frame comprises: an upper plate member which is mounted on the top of the wale member; a supporting plate member a part of which is hooked by the lower surface of the first plate part; and a plate connection member which is configured to connect in a separable state the upper plate member and the supporting plate member.

2. The anchor of claim 1, wherein a first pedestal protrusion part is protruding from the wale fixing surface of the pedestal member, and the first pedestal protrusion part is provided at the upper side of the wale fixing surface in the widthwise direction of the wale member mounted on the wale fixing surface.

3. The anchor of claim 2, wherein a second pedestal protrusion part, which is disposed spaced apart from the first pedestal protrusion part, is protruding from the wale fixing surface of the pedestal member, and the second pedestal protrusion part is provided at the lower side of the wale fixing surface in the widthwise direction of the wale member mounted on the wale fixing surface.

4. The anchor of claim 1, wherein the second plate part further includes a support plate part which is horizontally disposed at a lower end of the second plate and is fixed.

5. The anchor of claim 1, further comprising a third plate part which is fixed upright at a lower end of the second plate part and includes a lower surface slanted upward or downward from one side to the other side.

6. The anchor of claim 5, wherein the pedestal member comprises a reinforcing plate part which is disposed upright at both sides of the second plate member and is fixed at the second plate part and the third plate part.

7. The anchor of claim 1, wherein the pedestal fixing frame further comprises a lower plate member which is disposed between the first wale part and the second wale part, wherein both ends thereof are protruding toward both sides in the widthwise direction of the first plate part, and the plate connection member passes through both ends thereof.

8. The anchor of claim 7, wherein a guide member is provided at both lower sides of the lower plate member and is protruding outward of both side ends of the first plate part.

9. The anchor of claim 7, wherein the plate connection member is an angle body at least one end of both ends of which is fixed at any of the upper plate member and the supporting plate member, wherein the angle body is connected to the other end thereof through a bolt engagement and is disposed between the first wale part and the second wale part, and the lower end of the angle body is fixed at the lower plate member, and the pedestal fixing frame further includes a plate fixing member which is configured to connect in a separable state the lower plate member and the supporting plate member.

10. The anchor of claim 1, wherein a fixing protrusion part protruding from between the first wale part and the second wale part is provided at the lower surface of the upper plate member.

11. The anchor of claim 1, wherein the plate connection member includes a first connection rod member and a second connection fixing rod member at least one end of both ends of each of which is connected using a bolt to any of the upper plate member and the supporting plate member, wherein the first connection rod member and the second connection fixing rod member are disposed at both sides in the widthwise direction of the first plate part.

12. The anchor of claim 11, wherein the first connection fixing rod member and the second connection fixing rod member are disposed between the first wale part and the second wale part and are configured to connect the upper plate member and the supporting plate member.

13. The anchor of claim 11, wherein the pedestal fixing frame further includes a lower plate member which is disposed between the first wale part and the second wale part, wherein both ends thereof are protruding toward both sides in the widthwise direction of the first plate part, and the plate connection member is passing through both ends thereof, and the first connection fixing rod member and the second connection fixing rod member are disposed at both outer sides in the widthwise direction of the first wale part and the second wale part, and the first connection fixing rod member or the second connection fixing rod member is passing through both ends of the supporting plate member, and the supporting plate member is connected to the lower plate member and an assistant fixing member.

14. The anchor of claim 1, further comprising:

a wale fixture which is configured to fix in a separable state the wale member at the pedestal member.

15. The anchor of claim 14, wherein the wale fixture comprises:

a fixing plate member which is mounted on the pedestal member;

a cover plate member at least a part of which is overlapped with the fixing plate part, and the other part of which is overlapped with a part of the lower side of the wale member;

a wale fixing bolt member which is passing through the fixing plate member and the cover plate member; and a wale fixing nut member which is engaged to the wale fixing bolt member.

16. A construction method for an earth anchor, comprising:

a step wherein the ground on which a soil retaining wall is constructed, is perforated;

a step wherein an extension line member is inserted in the perforated hole formed on the ground;

a step wherein a grout is injected and hardened in the perforated hole;

a step wherein a wale member is disposed at an outer side of the soil retaining wall, and a pedestal member is disposed between the wale member and the soil retaining wall, and then the pedestal member is fixed;

a step wherein the wale member is fixed at the pedestal member; and a step wherein a head block member at which the extension line member is fixed, is engaged to the wale member, wherein the step for fixing the pedestal member includes: a step wherein the wale member is mounted on a wale fixing surface of the pedestal member, and the wale member and the pedestal member are engaged using a pedestal fixing frame; a step wherein the position of the pedestal member is adjusted in such a way to move the pedestal member engaged to the wale member using the pedestal fixing frame in a state where the pedestal member is contacting with the outer surface of the soil retaining wall; and a step wherein the pedestal member the position of which has been determined, is fixed at the outer surface of the soil retaining wall, wherein the step for fixing the wale member at the pedestal member comprises: a step wherein the wale member is fixed separable at the pedestal member using a wale fixture; and a step wherein the pedestal fixing frame is separated and removed.

* * * * *